US007118396B2

(12) United States Patent
Ting

(10) Patent No.: US 7,118,396 B2
(45) Date of Patent: Oct. 10, 2006

(54) ELECTRICAL CARD CONNECTOR

(75) Inventor: Chien Jen Ting, Kunsan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,937

(22) Filed: Jun. 27, 2005

(65) Prior Publication Data

US 2006/0134989 A1 Jun. 22, 2006

(30) Foreign Application Priority Data

Dec. 17, 2004 (TW) ..... 93220376 U

(51) Int. Cl.
*H01R 13/62* (2006.01)
*H01R 13/648* (2006.01)

(52) U.S. Cl. ..... 439/159; 439/607

(58) Field of Classification Search ..... 439/159, 439/607

See application file for complete search history.

(56) References Cited

U.S. PATENT DOCUMENTS 5,871,365 A * 2/1999 Kajiura ..... 439/159
5,997,324 A * 12/1999 Ho et al. ..... 439/159
6,080,017 A * 6/2000 Yu et al. ..... 439/607
6,364,674 B1 * 4/2002 Kajiura ..... 439/159
6,609,936 B1 * 8/2003 Bricaud et al. ..... 439/607
6,773,273 B1 8/2004 Yu

* cited by examiner

*Primary Examiner*—Briggitte R. Hammond
(74) *Attorney, Agent, or Firm*—Wei Te Chung

(57) ABSTRACT

An electrical card connector comprises an insulating header (1) having a mounting face (10), a plurality of electrical contacts (2) retained in the insulating header (1) and each having a soldering portion (22) arranging along the mounting face (10) and an engaging portion (21) for electrically connecting with an inserted electronic card, and a metallic shell (5) defining a receiving room (57) with an opening (59), through which the electronic card is inserted into the receiving room (57) along a direction, and further having a metallic header (58) disposed at a longitudinal end of the receiving room (57) and far from the opening (59), which is assembled onto the insulating header (1). Wherein the card inserting direction is perpendicular to the mounting face (10).

7 Claims, 6 Drawing Sheets

ELECTRICAL CARD CONNECTOR

BACKGROUND OF THE INVENTION

1. Field of the Invention

The present invention generally relates to an electrical card connector, and in particular to an electrical card connector for perpendicularly electrically connecting a card with a printed circuit board.

2. Description of Related Art

Generally, a conventional card connector is parallelly assembled on a printed circuit board (PCB), that is, the insertion of an inserted card is parallel with the PCB, as a result, the card connector occupies a large horizontal space above the PCB. In order to save horizontal space above a PCB, an electrical card connector perpendicularly assembled on the PCB is disclosed, such as an electrical card connector assembly disclosed in U.S. Pat. No. 6,773,273. However, the electrical card connector assembly needs a transition connector mounted on a PCB for connecting the electrical card connector to the PCB, as a result, more vertical space is occupied by the transition connector and further the manufacturing cost is higher.

Therefore, the present invention is directed to solving the above problems by providing an improved electrical card connector which can be perpendicularly assembled on a PCB and without a transition device for connecting to the PCB.

SUMMARY OF THE INVENTION

Accordingly, an objection of the present invention is to provide an electrical card connector which saves horizontal space above a printed circuit board on which the electrical card connector is mounted.

Another objection of the present invention is to provide an electrical card connector which is directly connected on the printed circuit board without a transition connector and conveniently assembled and disassembled.

In order to achieve the objections set forth, an electrical card connector in accordance with the present invention comprises an insulating header having a mounting face, a plurality of electrical contacts retained in the insulating header and each having a soldering portion arranging along the mounting face and an engaging portion for electrically connecting with an inserted electronic card, and a metallic shell defining a receiving room with an opening, through which the electronic card is inserted into the receiving room along a direction, and further having a metallic header disposed at a longitudinal end of the receiving room and far from the opening, which is assembled onto the insulating header. Wherein the card inserting direction is perpendicular to the mounting face.

Other objects, advantages and novel features of the present invention will become more apparent from the following detailed description of the present embodiment when taken in conjunction with the accompanying drawings.

DETAILED DESCRIPTION OF THE INVENTION

Figure 1:
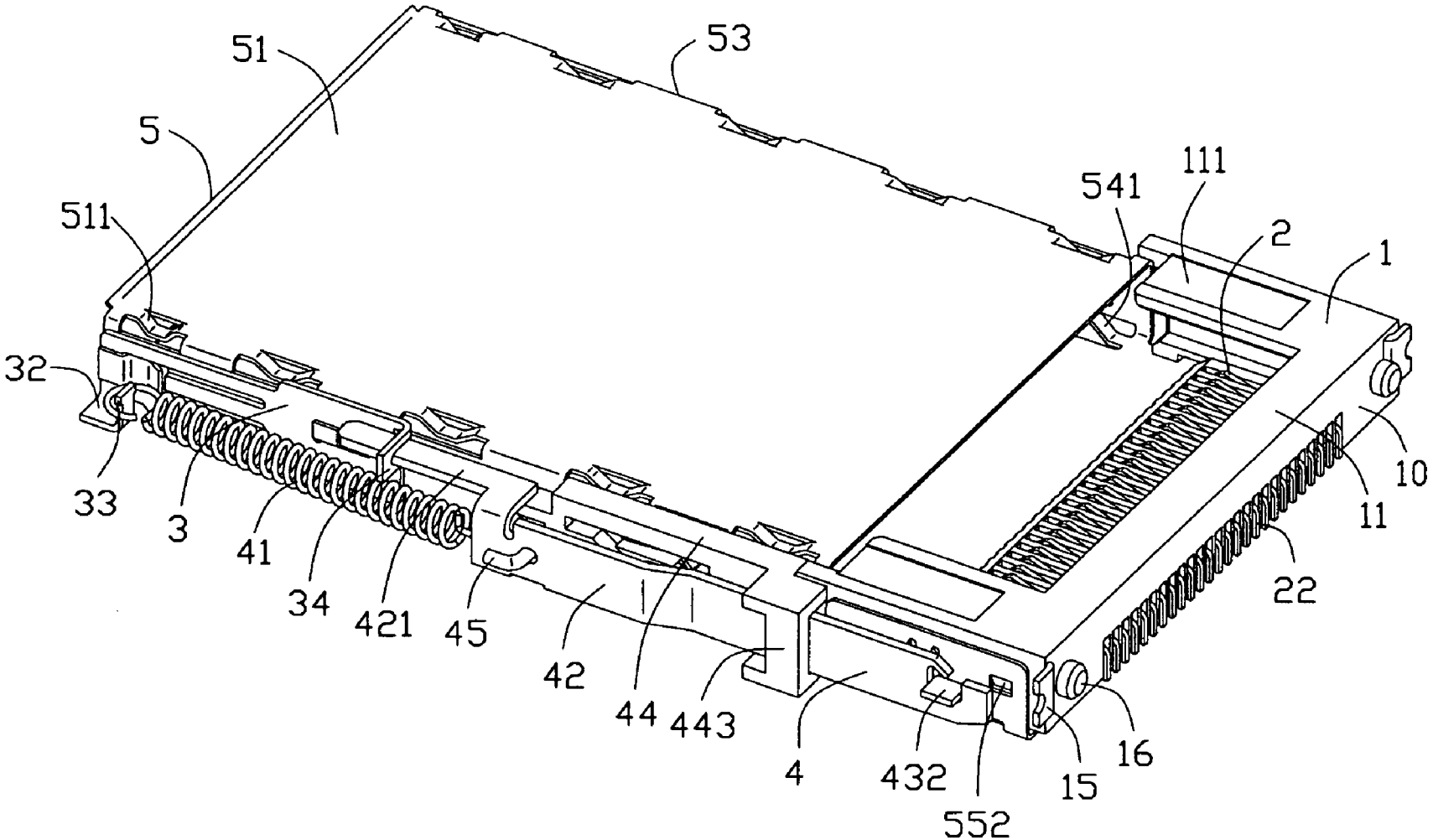
FIG. 1 is a perspective assembled view of an electrical card connector according to the present invention.
Figure 2:
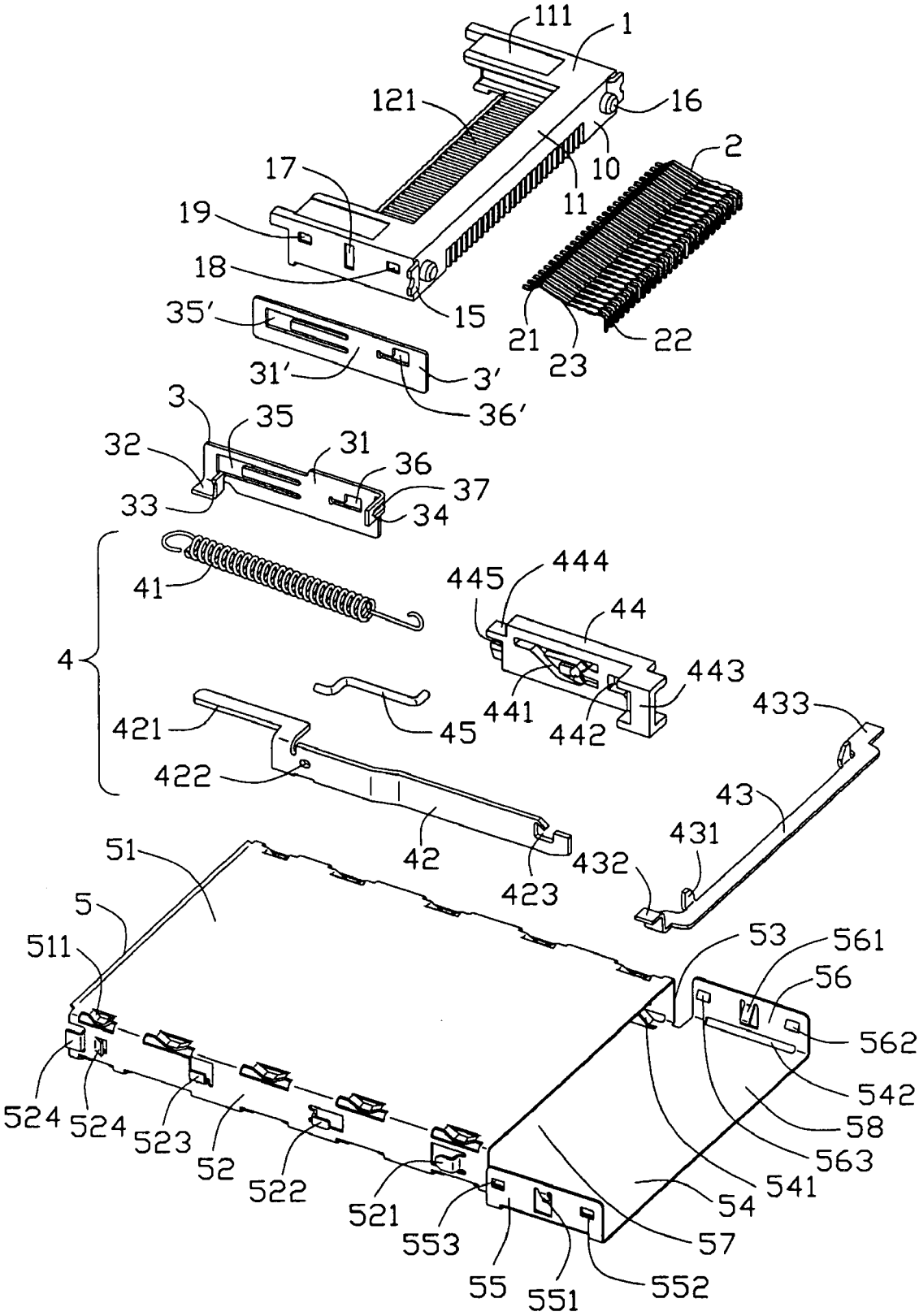
FIG. 2 is a perspective exploded view of the electrical card connector.

Referring to FIGS. 1 and 2, an electrical card connector in accordance with the present invention comprises an insulating header 1, a plurality of electrical contacts 2 retained in the insulating header 1, a metallic shell 5 assembled to the insulating header 1, a pair of stand-off devices 3, 3' secured on opposite sides of the metallic shell 5, and an ejector 4 attached to one side of the metallic shell 5 for ejecting an inserted electronic card (not shown) therefrom.

Figure 5:
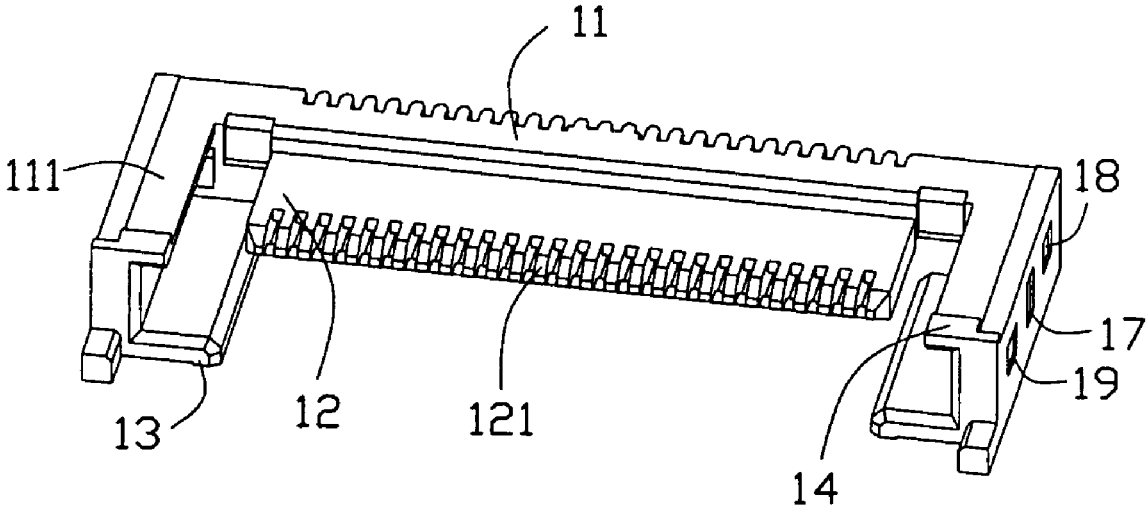
FIG. 5 is a perspective view of an insulating header of the electrical card connector seen from a rear side.

Combining with FIG. 5, the insulating header 1 has a longitudinal base 11, a pair of guiding arms 111 extending backwards from two opposite longitudinal ends of the longitudinal base 11 and a card engaging section 12 protruding backwards from a middle of the longitudinal base 11. The longitudinal base 11 has a mounting face 10 perpendicular to the guiding arms 111 and the card engaging section 12. The card engaging section 12 defines a plurality of passageways 121 extending through the mounting face 10 for retaining the electrical contacts 2. The guiding arm 111 has a lower wall 13, an upper wall 14 and a guiding groove defined between the lower wall 13 and the upper wall 14, which is adapted for guiding the electronic card inserted to electrically engage with the electrical contacts 2. The distance between two parallel lower walls 13 is shorter than that between two parallel upper walls 14 so as to prevent the electronic card, such as an Express Card from being inserted reversely into the electrical card connector.

Each electrical contact 2 has a securing portion 23 retained in the passageway 121 of the card engaging section 12, an engaging portion 21 extending backwardly from an end of the securing portion 23 for engaging with the electronic card, and a soldering portion 22 bending downwardly from the other end of the securing portion 23. The soldering portions 22 arrange along the mounting face 10 of the insulating header 1 for soldered on a printed circuit board (PCB) 6.

The metallic shell 5 defines a receiving room 57 with an opening 59 (as figured in FIG. 6) exposed to a shell of a computer for the electronic card inserted into the receiving room 57. The metallic shell 5 further provides a metallic head 58 disposed at a longitudinal end of the receiving room 57 and far from the opening 59. The receiving room 57 is enclosed by a first bottom wall, a pair of first sidewalls 52, 53 bending upwardly from the first bottom wall and a top wall 51. The metallic head 58 has a second bottom wall 54 extending from the first bottom wall of the receiving room 57 and a pair of second sidewalls 55, 56 bending upwardly from the second bottom wall 54. Further, the distance between the second sidewalls 55, 56 is longer than that between the first sidewalls 52, 53. Moreover, a plurality of first elastic pieces 511 are provided at joints of the top wall 51 and the first sidewalls 52, 53 and a plurality of second elastic pieces 541 are also provided at joints of the first bottom wall and the first sidewalls 52, 53. For the distance between the first elastic piece 511 and the second elastic piece 541 is shorter than that between the top wall 51 and the first bottom wall, the inserted electronic card is secured in the receiving room 57. The first sidewall 52 provides with a locking barb 524, a locking hook 523, a securing clasp 522, a securing tab 521 from an end close to the opening 59 to the other end close to the metallic header 58 in sequence. In the same way, the first sidewall 53 also has some similar structures.

Figure 3:
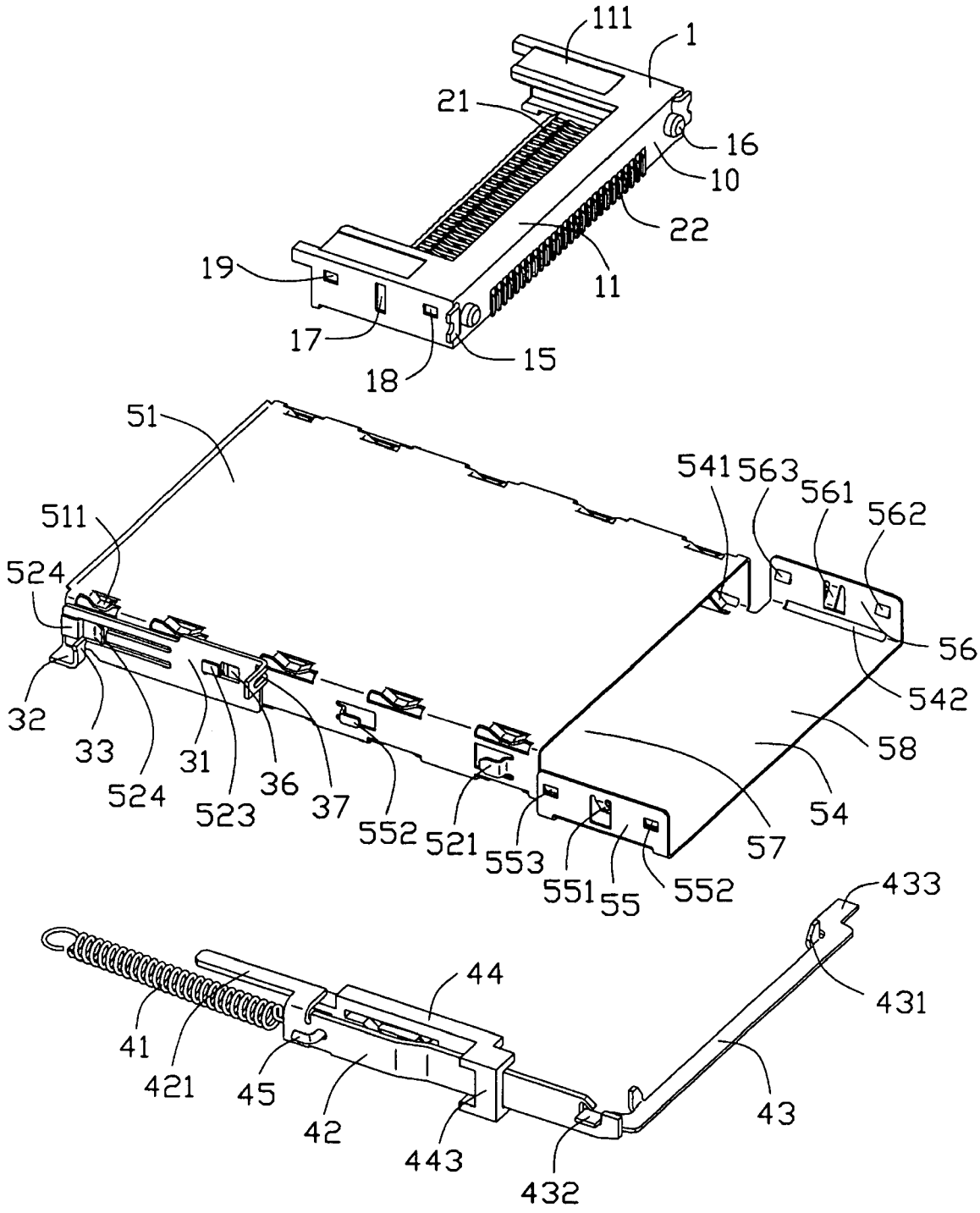
FIG. 3 is a perspective view showing a metallic shell of the electrical card connector assembled with a stand-off device and a separate ejector of the electrical card connector.

Referring to FIGS. 2 and 3, the stand-off device 3 has a retention portion 31 secured to the first sidewall 52 of the metallic shell 5, a first tab 32 extending perpendicularly from a lower edge of the retention portion 31, and a second tab 34 extending perpendicularly from an upper edge of the retention portion 31. The retention portion 31 defines a first lock hole 35 proximate the first tab 32 for retaining the locking barb 524 of the metallic shell 5 therein and a second lock hole 36 proximate the second tab 34 for retaining the locking hook 523 therein, thereby securing the stand-off device 3 on the first sidewall 52 of the metallic shell 5. On the other hand, the stand-off device 3' has a retention portion 31' secured to the first sidewall 53 of the metallic shell 5 and defining a first and second lock holes 35', 36' respectively for retaining corresponding structures on the first sidewall 53 of the metallic shell 5 therein, thereby securing the stand-off device 3' on the first sidewall 53 of the metallic shell 5.

Figure 4:
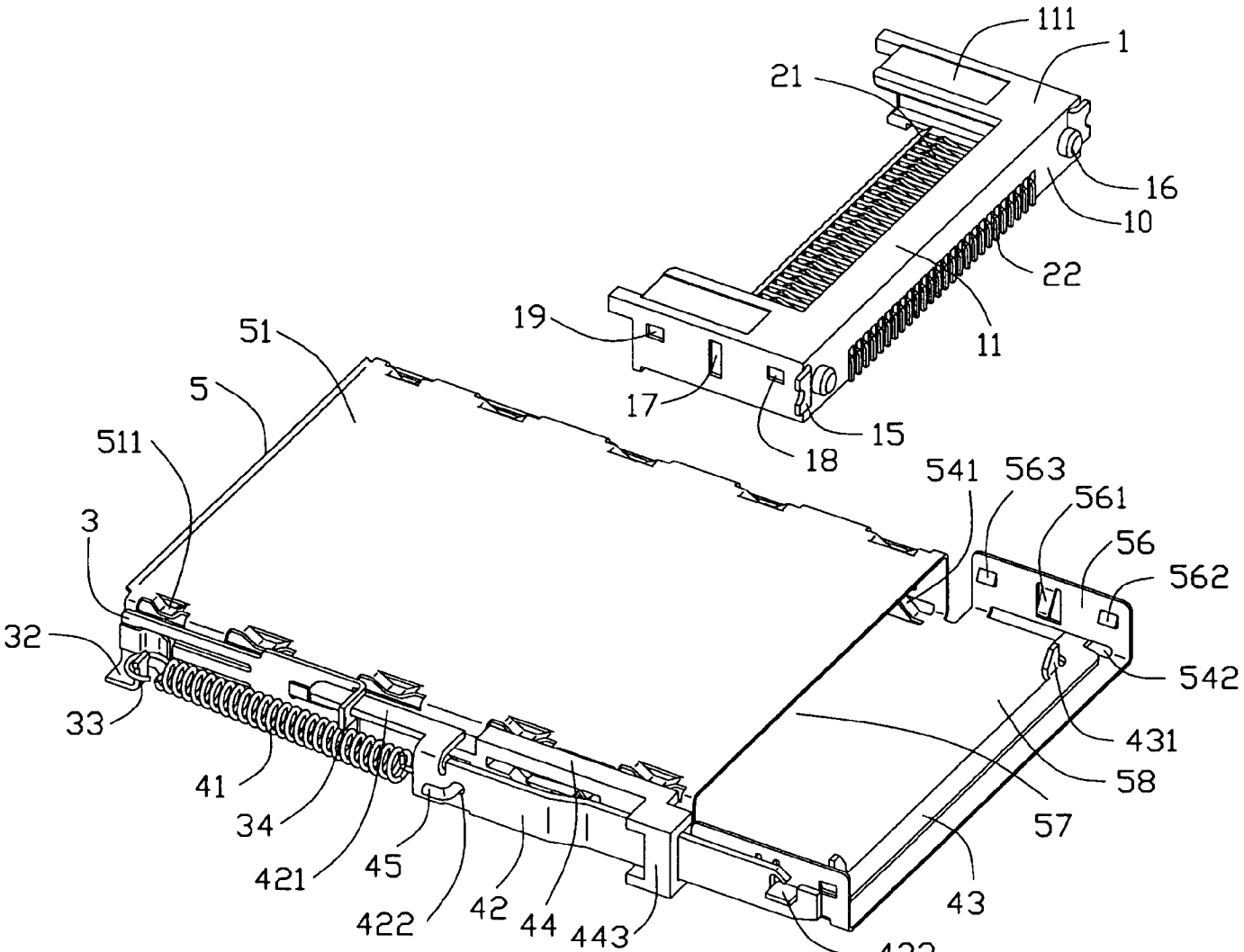
FIG. 4 is a perspective view showing the metallic shell of FIG. 3 assembled with the ejector.

As shown in FIGS. 2–4, the ejector 4 is assembled to the first sidewall 52 of the metallic shell 5 and disposed at the same side with the stand-off device 3. The ejector 4 comprises a base 44 secured on the first sidewall 52 of the metallic shell 5, a guider pin 45 with one end connecting to the base 44, a push bar 42 connected to the other end of the guider pin 45, a spring 41 with one end connected to a center of the guider pin 45 and the other end connected to a third tab 33 extending upwardly from the first tab 32 of the stand-off device 3, and an ejecting plate 43 with one end connecting to the push bar 42. The base 44 has a body portion, a heart groove 441 defined in the body portion, a post 443 protruding from the body portion, and a supporting portion 444 extending backwardly from the body portion. The supporting portion 444 defines a third lock hole 445 for retaining the securing clasp 522 of the metallic shell 5 therein and the body portion of the base 44 defines a fourth lock hole 442 proximate the post 443 for retaining the securing tab 521 of the metallic shell 5 therein, thereby securing the base 44 on the first sidewall 52 of the metallic shell 5. The push bar 42 has a body portion assembled through the post 443 of the base 44, a connecting portion 421 bending upwardly from an end of the body portion and parallel to the body portion, an indentation 423 disposed at the other end of the body portion, and an aperture 422 defined in the body portion proximate the connecting portion 421. The connecting portion 421 is assembled on a top wall of the supporting portion 444 of the base 44 and further through a cutout 37 defined in the second tab 34 of the stand-off device 3. The guider pin 45 has the end connecting to the heart groove 441, and the opposite end extending through the aperture 422 of the push bar 42. The ejecting plate 43 has a body portion, a pair of contacting portions 431 extending upwardly from the body portion and proximate two opposite ends of the body portion, a locking portion 432 bending upwardly from an end of the body portion and parallel to the body portion, and a sliding portion 433 extending from the opposite end of the body portion. The locking portion 432 is secured in the indentation 423 of the push bar 42.

Further referring to FIGS. 1, 2 and 4, the metallic shell 5 is assembled to the insulating header 1 with a spring tab 551 formed on the second sidewall 55 of the metallic header 58 secured in a middle hole 17 defined in an outer sidewall of the guiding arm 111, and two projections 553, 552 formed on the second sidewall 55 and at two sides of the spring tab 551 respectively secured in two holes 19, 18 defined in the outer sidewall of the guiding arm 111, similarly, with another spring tab 561 and another two projections 563, 562 formed on the opposite second sidewall 56 respectively secured in three holes (not shown) defined in the opposite guiding arm 111. The ejecting plate 43 is assembled between a bottom surface of the insulating header 1 and the second bottom wall 54 of the metallic header 58 with the locking portion 432 extending through the second sidewall 55 to secured in the indentation 423 of the push bar 42 and the sliding portion 433 received in a slot 542 defined at a joint between the second sidewall 56 and the second bottom wall 54 of the metallic header 58. When the electronic card is inserted from the opening 59 into the receiving room 57 of the metallic shell 5 and pushes the pair of contacting portions 431 of the ejecting plate 43, which is originally slant in the metallic header 58, the sliding portion 433 of the ejecting plate 43 is sliding ahead along the slot 542 of the metallic header 58, simultaneously, the guider pin 45 is moving along the heart groove 441 till stopping at a position, as a result, the electronic card electrically engages with the electrical contacts 2. When releasing the electronic card from the receiving room 57, the electronic card is further pushed so that the guider pin 45 slides over the position, then the ejecting plate 43 is sliding backwardly along the slot 542 at the force of the spring 41 acting on the push bar 42, as a result, the inserted electronic card is released.

Figure 6:
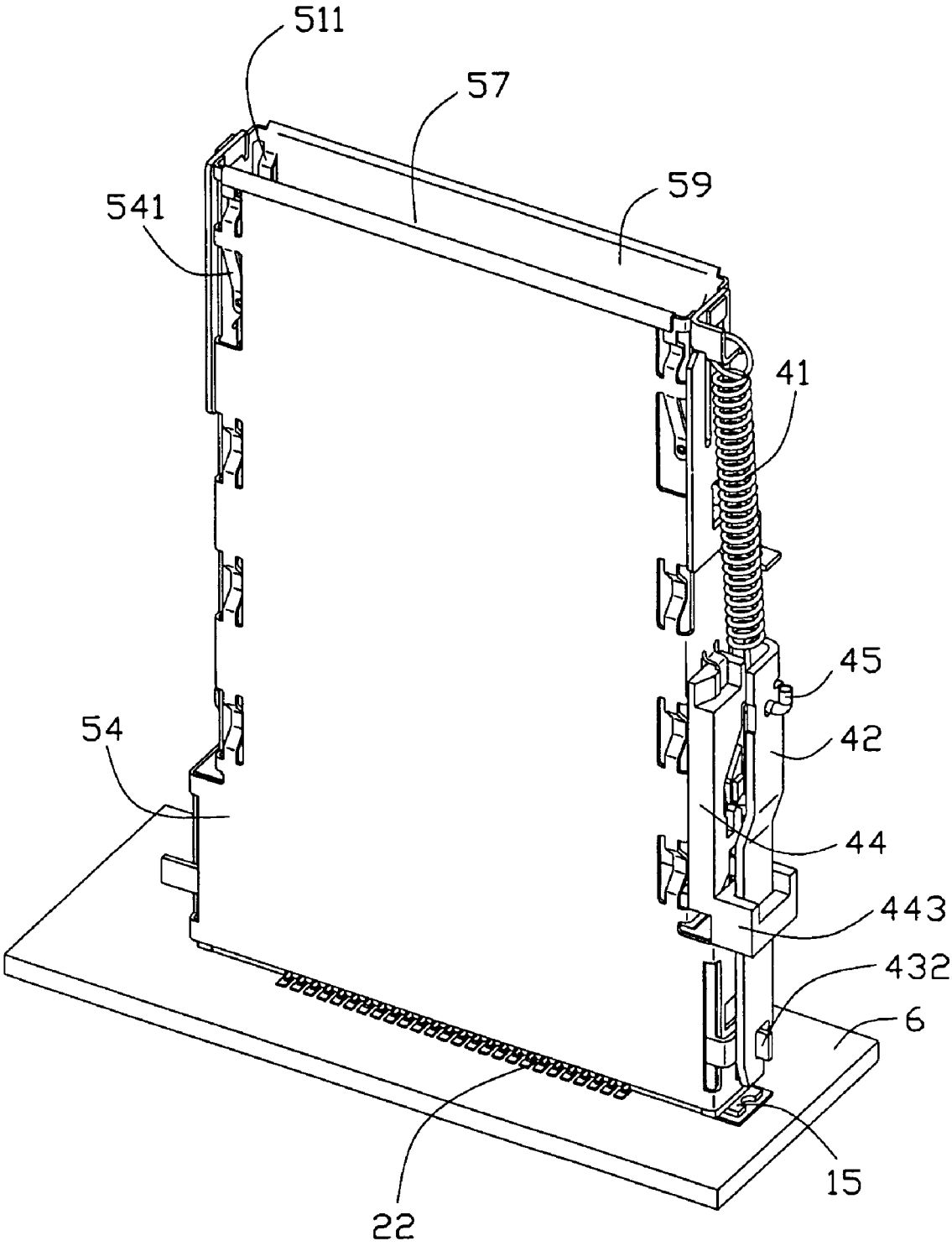
FIG. 6 is a perspective assembled view showing the electrical card connector assembled to a printed circuit board.

Finally, referring to FIGS. 1 and 6, the assembled electrical card connector is perpendicularly assembled on the PCB 6 with the mounting face 10 of the insulating header 1 engaging with the PCB 6 and the pair of guiding arms 111 being perpendicular to the PCB 6. Furthermore, the soldering portions 22 of the electrical contacts 2 are directly soldered on the PCB 6. The insulating header 1 further has a pair of guiding posts 16 at two longitudinal ends of the mounting face 10 adapted for guiding the electrical card connector assembled to the PCB 6 and a pair of securing tabs 15 at joints of the longitudinal base 11 and the guiding arms 111 adapted for soldered on the PCB 6.

Accordingly, the electrical card connector is perpendicularly assembled on the PCB 6 so that horizontal space above the PCB 6 is notably saved and further the size of electrical device is notably reduced. Secondly, the soldering portions 22 of the electrical contacts 2 are directly soldered on the PCB 6 so that a transition device is reduced and the quality of data transmission is improved. Finally, the insulating header 1 is directly assembled to the metallic shell 5 so that the electrical card connector is conveniently assembled and disassembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector assembly comprising:

an insulative housing defined an elongated direction and including a plurality of contacts therein;

a metallic shielding attached to the housing;

a wall structure defined by at least one of said housing and the shielding and forming a card receiving space for receiving an electronic card therein;

an ejector assembled to the shielding and essentially located beside an elongated end of said housing, said ejector including a push bar back and forth moveable along a mating direction of said electronic card, and an ejecting plate extending essentially along a full transverse dimension of the housing and having contacting tabs thereon for pushing the inserted card, a first end of said ejecting plate latchably engaged with a rear portion of the push bar.

2. The connector assembly as claimed in claim 1, wherein the wall structure is formed by the shielding, and the shield includes a head section to allow the housing to be assemble to the shield in a direction which is perpendicular to both the card insertion direction and said elongated direction of the housing.

3. The connector assembly as claimed in claim 1, wherein a second end of said ejecting plate opposite to the first end restrictively engaged with the shielding so as to assure the ejecting plate is moved relative to the shielding in a horizontal and parallel direction without any movement in a direction perpendicular to said horizontal direction.

4. The connector assembly as claimed in claim 3, wherein the push bar is essentially fully exposed outside of the shield.

5. The connector assembly as claimed in claim 1, further including a printed circuit board on which the housing is vertically seated so as to have the care insertion direction is perpendicular to said printed circuit board.

6. The card connector assembly as claimed in claim 5, further including a printed circuit board on which the housing is vertically seated so as to have the care insertion direction is perpendicular to said printed circuit board.

7. An electrical card connector assembly comprising:

an insulative housing defined an elongated direction and including a plurality of contacts therein;

a metallic shielding attached to the housing;

a wall structure defined by at least one of said housing and the shielding and forming a card receiving space for receiving an electronic card therein;

an ejector assembled to the shielding and essentially located beside an elongated end of said housing, said ejector including a push bar back and forth moveable along a mating direction of said electronic card, and an ejecting plate with at least one contacting tab thereon for pushing the inserted card, a first end of said ejecting plate latchably engaged with a rear portion of the push bar; wherein the push bar is essentially fully exposed outside of the shield.

* * * * *